US008096497B2

(12) United States Patent
Luo

(10) Patent No.: US 8,096,497 B2
(45) Date of Patent: Jan. 17, 2012

(54) POWER ASSEMBLY AND A COAXIAL TWIN PROPELLER MODEL HELICOPTER USING THE SAME

(76) Inventor: Zhihong Luo, Guangzhou (CN)

( * ) Notice: Subject to any disclaimer, the term of this patent is extended or adjusted under 35 U.S.C. 154(b) by 601 days.

(21) Appl. No.: 12/264,552

(22) Filed: Nov. 4, 2008

(65) Prior Publication Data

US 2009/0134269 A1 May 28, 2009

(30) Foreign Application Priority Data

Nov. 26, 2007 (CN) ..... 2007 2 0060095 U

(51) Int. Cl.
*B64C 25/00* (2006.01)
*B64C 27/00* (2006.01)
*B64C 35/00* (2006.01)

(52) U.S. Cl. ..... 244/17.17; 244/17.19; 244/17.23; 244/17.25; 244/60

(58) Field of Classification Search ..... 244/17.23, 244/17.25, 17.21, 17.19, 17.17, 60
See application file for complete search history.

(56) References Cited

U.S. PATENT DOCUMENTS 3,572,616 A * 3/1971 Ulisnik ..... 244/17.23
5,609,312 A * 3/1997 Arlton et al. ..... 244/17.11
5,836,545 A * 11/1998 Arlton et al. ..... 244/60
6,886,777 B2 * 5/2005 Rock ..... 244/17.23
2002/0109044 A1 * 8/2002 Rock ..... 244/17.23
2006/0102777 A1 * 5/2006 Rock ..... 244/17.25
2007/0164148 A1 * 7/2007 Van De Rostyne ..... 244/17.21
2007/0164149 A1 * 7/2007 Van de Rostyne ..... 244/17.21
2007/0164150 A1 * 7/2007 Van de Rostyne ..... 244/17.21
2007/0221781 A1 * 9/2007 Van de Rostyne ..... 244/17.25
2007/0272794 A1 * 11/2007 Van de Rostyne ..... 244/17.23
2009/0084891 A1 * 4/2009 Darrow et al. ..... 244/17.19
2009/0127380 A1 * 5/2009 Li ..... 244/17.23
2009/0146001 A1 * 6/2009 Taya ..... 244/60
2010/0025525 A1 * 2/2010 Van de Rostyne et al. 244/17.19

* cited by examiner

*Primary Examiner* — David H Bollinger
(74) *Attorney, Agent, or Firm* — Global IP Services; Tianhua Gu

(57) ABSTRACT

A coaxial twin propeller model helicopter comprises a power assembly, a twin propeller rotation assembly, a tail rotation assembly, a motor assembly and a gear assembly. The twin propeller rotation assembly comprises a main rotation assembly and a minor rotation assembly. The power assembly comprises a motor assembly having a motor, a motor gear, and a fuel tank and a gear assembly having a main gear, a synchronous belt gear and a belt pulley. The main gear is engaged with the motor gear, and connected to the main rotation assembly. A lower part of the main gear is connected to the synchronous belt gear which connects to said minor rotation assembly. An upper end of the belt pulley is connected to said tail rotation assembly. A middle part of the belt pulley is engaged with the main gear. A lower end of the belt pulley is connected to the synchronous belt gear.

10 Claims, 3 Drawing Sheets

POWER ASSEMBLY AND A COAXIAL TWIN PROPELLER MODEL HELICOPTER USING THE SAME

CROSS REFERENCE TO RELATED PATENT APPLICATION

This application claims the priority of the Chinese patent application No. 200720060095.1 filed on Nov. 26, 2007, which application is incorporated herein by reference.

BACKGROUND OF THE INVENTION

1. Field of the Invention

The present invention relates to a coaxial twin propeller model helicopter, especially relates to a power assembly used for driving the coaxial twin propeller model helicopter.

2. Description of the Prior Art

The model helicopter is popular since appeared, and the manufacturers developed and improved new model helicopters continuously with simple structure, easy assembly, stable flight, and easy control to satisfy consumer demands. At present, the power supply system, both with fuel and with electric energy, used for driving twin propeller rotation assembly and tail rotation assembly in a coaxial twin propeller model helicopter is comprised of two motors and two main gears, however, the process and technology of assembling two motors and two main gears is complex, which cause high costs in manufacture and maintenance.

It is therefore in more need of a power assembly with simple structure, easy assembly, and stable flight, meanwhile, the power assembly can drive twin propeller rotation assembly and tail rotation assembly synchronously with one motor.

BRIEF SUMMARY OF THE INVENTION

One object of the present invention is to provide a power assembly with simple structure, easy assembly, and stable flight, meanwhile, said power assembly drive a twin propeller rotation assembly and a tail rotation assembly synchronously with one motor.

The other object of the present invention is to provide a coaxial twin propeller model helicopter with a power assembly, said power assembly has simple structure, easy assembly, and stable flight, meanwhile, said power assembly drive a twin propeller rotation assembly and a tail rotation assembly synchronously with one motor.

To achieve the object, the technical solution of the present invention is to provide a power assembly which is suitable for installing on a bracket of a coaxial twin propeller model helicopter and used for driving a twin propeller rotation assembly and a tail rotation assembly of said coaxial twin propeller model helicopter at the same time, said twin propeller rotation assembly composed of a main rotation assembly and a minor rotation assembly, wherein, said power assembly comprising a motor assembly and a gear assembly, said motor assembly comprising a motor, a motor gear, and a fuel tank, said motor and fuel tank fixed on said bracket, said motor connected to said motor gear, said fuel tank provided fuel to said motor by a pipe, said motor driving said motor gear, said gear assembly comprising a main gear, a synchronous belt gear and a belt pulley, said main gear engaged said motor gear, said main gear connected to said main rotation assembly of said twin propeller rotation assembly, a lower part of said main gear connected to said synchronous belt gear, said synchronous belt gear connected to said minor rotation assembly of said twin propeller rotation assembly, an upper end of said belt pulley connected to said tail rotation assembly, a middle part of said belt pulley engaged said main gear, a lower end of said belt pulley connected to said synchronous belt gear.

Further, said upper end of said belt pulley connected to said tail rotation assembly by a belt, said lower end of said belt pulley connected to said synchronous belt gear by a belt, which ensure the force stationary of the upper, middle, and lower part of said belt pulley, thus ensuring the normal operation of said tail rotation assembly.

Further, said main gear, said synchronous belt gear, and said belt pulley have the same modulus, thereof ensuring the stability of rotating synchronously of said main rotation assembly, said minor rotation assembly, and said tail rotation assembly.

The present invention provide a coaxial twin propeller model helicopter with a power assembly, which is including a bracket and a twin propeller rotation assembly, a power assembly, a landing gear, an electronic module, a steering gear, and a tail rotation assembly installing on said bracket, said power assembly driving said twin propeller rotation assembly and said tail rotation assembly, said electronic module controlling said steering gear, said steering gear realizing steering control of model helicopter by controlling the inclination direction of said twin propeller rotation assembly, said twin propeller rotation assembly including a main rotation assembly and a minor rotation assembly, wherein said power assembly comprising a motor assembly and a gear assembly, said motor assembly comprising a motor, a motor gear, and a fuel tank, said motor and fuel tank fixed on said bracket, said motor connected to said motor gear, said fuel tank provided fuel to said motor by a pipe, said motor driving said motor gear, said gear assembly comprising a main gear, a synchronous belt gear and a belt pulley, said main gear engaged said motor gear, said main gear connected to said main rotation assembly of said twin propeller rotation assembly, a lower part of said main gear connected to said synchronous belt gear, said synchronous belt gear connected to said minor rotation assembly of said twin propeller rotation assembly, an upper end of said belt pulley connected to said tail rotation assembly, a middle part of said belt pulley engaged said main gear, a lower end of said belt pulley connected to said synchronous belt gear.

Further, said main rotation assembly comprising a plurality of main blade, a main blade clip, a hollow axle, and an inclined plate, said main blade evenly distributed in said main blade clip, the upper end of said hollow axle fixed and connected to said main blade clip, the lower end of said hollow axle fixed and connected to said main gear, said inclined plate connected between said main blade clip and said steering gear, said main gear driving said main blade clip rotating, said steering gear controlling inclination direction of said main blade clip through driving said inclined plate.

Further, said minor rotation assembly comprising a plurality of minor blade, a minor blade clip, a small axle, and a balancing rod assembly, said minor blade evenly distributed in said minor blade clip, said small axle passing through said minor blade clip and fixing connected to said minor blade clip, the lower end of said small axle fixed and connected to said synchronous belt gear, the top of said small axle fixed and connected to said balancing rod assembly, said synchronous belt gear driving said minor blade clip and balancing rod assembly rotating.

As compared with the prior art, the present invention provide a power assembly comprised of single motor to drive said twin propeller rotation assembly and said tail rotation assembly synchronously, and realized synchronous operation of said twin propeller rotation assembly and said tail rotation assembly, thereof improved flight stability of model helicopter. The model helicopter in present invention has simple structure and easy assembly, and avoid traditional dynamical model providing by two motors and two main gears in a coaxial twin propeller model helicopter, thus simplify the power system of model helicopter.

The present invention can be further understood and appreciated from the following detailed description and examples when taken in conjunction with the attached drawings.

DETAILED DESCRIPTION OF THE INVENTION

Figure 1:
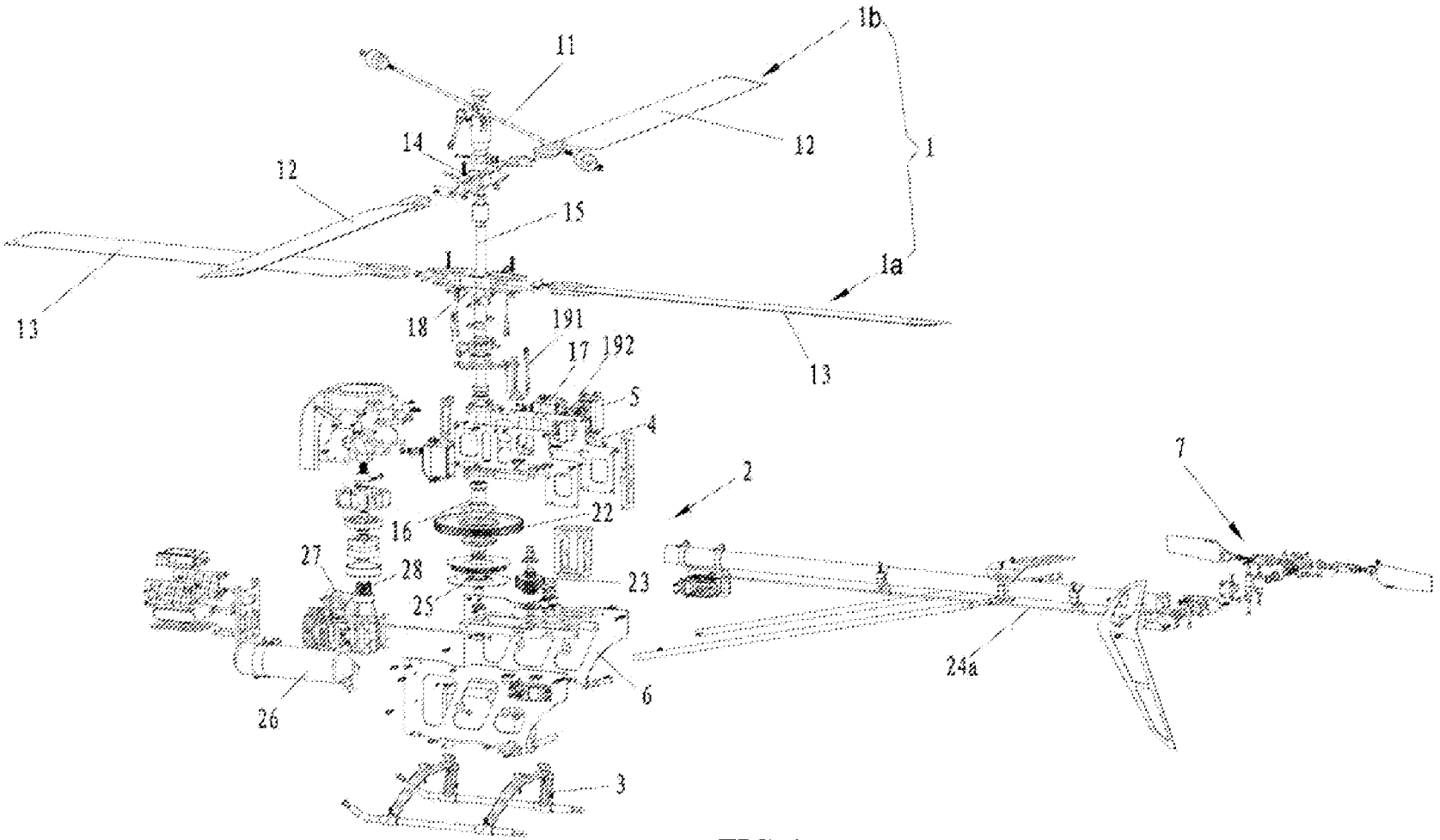
FIG. 1 is a structural diagram of a coaxial twin propeller model helicopter of the present invention.

The present invention provide a coaxial twin propeller model helicopter in FIG. 1 comprising a bracket 6 and a twin propeller rotation assembly 1, a power assembly 2, a landing gear 3, an electronic module 4, a steering gear 5, and a tail rotation assembly 7, which are installing on said bracket 6, said power assembly 2 driving said twin propeller rotation assembly 1 and said tail rotation assembly 7, said electronic module 4 controlling said steering gear 5, said steering gear 5 realizing steering control of model helicopter by controlling the inclination direction of said twin propeller rotation assembly 1, said twin propeller rotation assembly 1 including a main rotation assembly 1*a* and a minor rotation assembly 1*b*.

Figure 2:
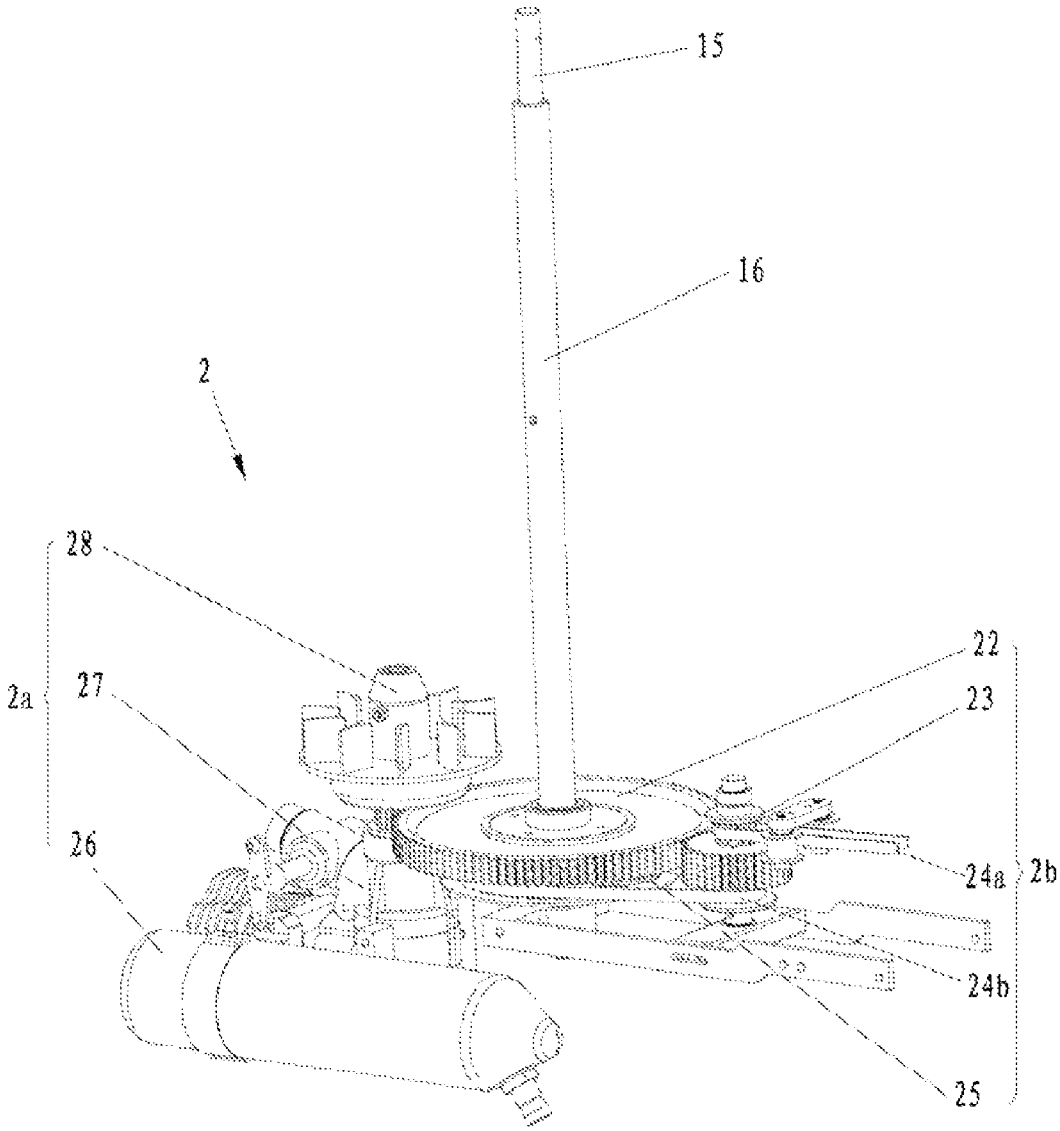
FIG. 2 is a structural diagram of a power assembly of the present invention.
Figure 3:
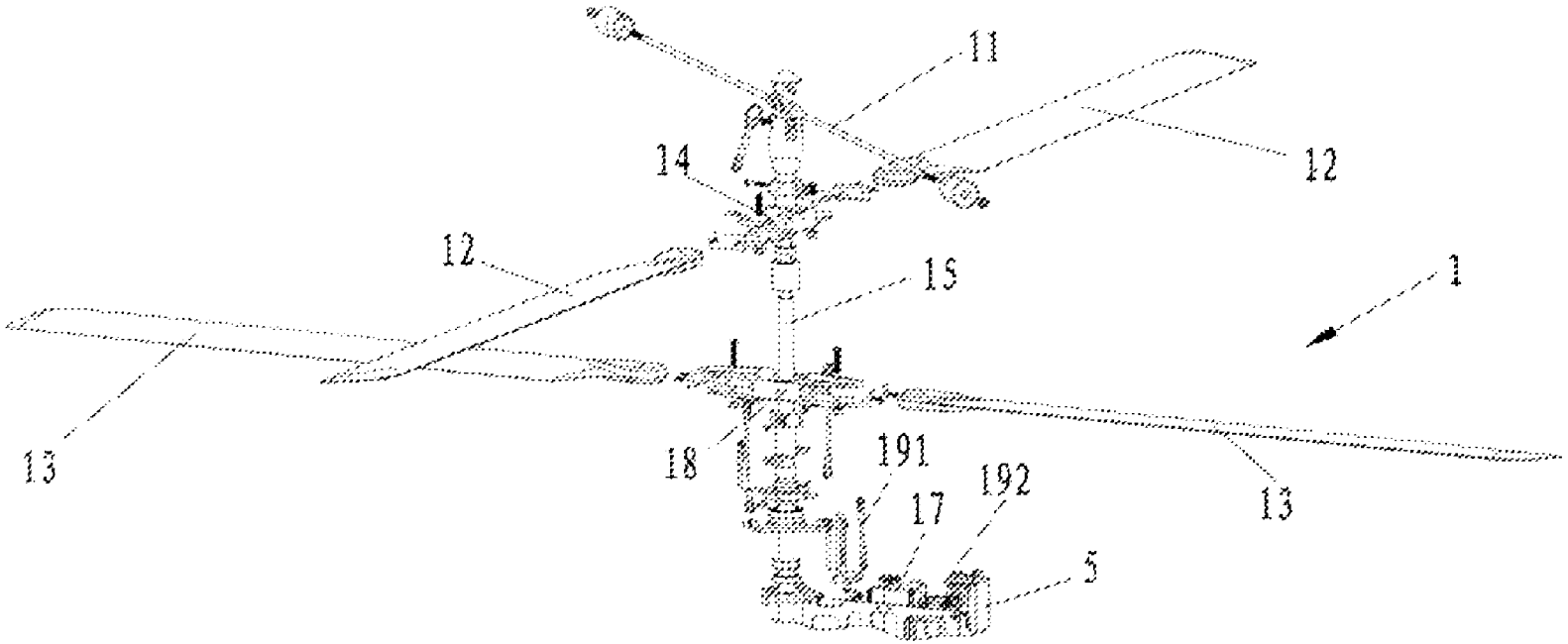
FIG. 3 is a structural diagram of a twin propeller rotation assembly in the coaxial twin propeller model helicopter of the present invention.

Said power assembly 2 comprises a motor assembly 2*a* and a gear assembly 2*b* shown in FIG. 2 and FIG. 3, said motor assembly 2*a* comprising a motor 27, a motor gear 28, and a fuel tank 26, said motor 27 and fuel tank 26 fixed on said bracket 6, said motor 27 connected to said motor gear 28, said fuel tank 26 provided fuel to said motor by a pipe, said motor 27 driving said motor gear 28. Said gear assembly 2*b* comprises a main gear 22, a synchronous belt gear 25 and a belt pulley 23, said main gear 22 engaged said motor gear 28, said main gear 22 connected to said main rotation assembly 1*a* of said twin propeller rotation assembly 1, a lower part of said main gear 22 connected to said synchronous belt gear 25 by a fixed part, said synchronous belt gear 25 connected to said minor rotation assembly 1*b* of said twin propeller rotation assembly 1, an upper end of said belt pulley 23 connected to said tail rotation assembly 7, a middle part of said belt pulley 23 engaged said main gear 22, a lower end of said belt pulley 23 connected to said synchronous belt gear 25.

Further, said main rotation assembly l*a* comprises a plurality of main blade 13, a main blade clip 18, a hollow axle 16, and an inclined plate 17, said main blade 13 evenly distributed in said main blade clip 18, the upper end of said hollow axle 16 fixed and connected to said main blade clip 18 by a fixed part, the lower end of said hollow axle 16 fixed and connected to said main gear 22 by a fixed part, said inclined plate 17 connected between said main blade clip 18 and said steering gear 5, said main gear 22 driving said main blade 13 rotating by said main blade clip 18. Particularly, the upper end of said inclined plate 17 connected to said main blade clip 18 by a pull rod 191, the lower end of said inclined plate 17 connected to said steering gear 5 by a pull rod 192, said electronic module 6 electrically connected to said steering gear 5, said electronic module 6 controlled rotation of said steering gear 5, said steering gear 5 controlling inclination direction of said main blade clip 18 through said pull rod 191 and said pull rod 192, and the inclination of said main blade clip 18 further driving main blade 13 which is fixed and connected to said main blade clip 18 thereof realizing steering control of model helicopter.

Said minor rotation assembly 1*b* comprises a plurality of minor blade 12, a minor blade clip 14, a small axle 15, and a balancing rod assembly 11, said minor blade 12 evenly distributed in said minor blade clip 14, said small axle 15 passing through said minor blade clip 14 and connected to said minor blade clip 14 by fixed part, the lower end of said small axle 15 fixed and connected to said synchronous belt gear 25 by fixed part, the top of said small axle 15 fixed and connected to said balancing rod assembly 11 by fixed part, said synchronous belt gear 25 driving said minor blade clip 14 and balancing rod assembly rotating, said minor blade clip 14 further driving the rotation of minor blade 12 which is fixed and connected to said minor blade clip 14.

Further, the upper end of said belt pulley 23 connected to said tail rotation assembly 7 by a belt 24*a*, and the lower end of said belt pulley 23 connected to said synchronous belt gear 25 by a belt 24*b*, which ensure the force stationary of the upper, middle, and lower part of said belt pulley 23, thus ensuring the normal operation of said tail rotation assembly 7.

Further, said motor assembly 2*a* further comprising a fuel pump, said fuel pump setting between said fuel tank 26 and said motor 27, and ensuring the smooth supplying of fuel from said fuel tank 26 to said motor 27.

Further, said main gear 22, said synchronous belt gear 25, and said belt pulley 23 have the same modulus, thereof ensuring the stability of rotating synchronously of said main rotation assembly 1*a*, said minor rotation assembly 2*a*, and said tail rotation assembly 7.

The present invention provide said power assembly 2 comprised of single motor 27 to drive said twin propeller rotation assembly 1 and said tail rotation assembly 7 synchronously, and realized synchronous operation of said twin propeller rotation assembly 1 and said tail rotation assembly 7, thereof improved flight stability of model helicopter. The model helicopter in present invention has simple structure and easy assembly, and avoid traditional dynamical model providing by two motors and two main gears in a coaxial twin propeller model helicopter, thus simplify the power system of model helicopter.

The description mentioned above is the optimization embodiment, and it is impossible to determine the range of the claim on the basis of the description above, therefore, the equate changes based on the application still belong to the scope of protection claimed in present invention.

What is claimed is:

1. A power assembly, suitable for installing on a bracket of a coaxial twin propeller model helicopter, used for driving a twin propeller rotation assembly and a tail rotation assembly of said coaxial twin propeller model helicopter at the same time, said twin propeller rotation assembly composed of a main rotation assembly and a minor rotation assembly, said power assembly comprising:

a motor assembly, said motor assembly comprising a motor, a motor gear, and a fuel tank, said motor and fuel tank fixed on said bracket, said motor connected to said motor gear, said fuel tank provided fuel to said motor by a pipe, said motor driving said motor gear, and a gear assembly, said gear assembly comprising a main gear, a synchronous belt gear and a belt pulley, said main gear engaged said motor gear, said main gear connected to said main rotation assembly of said twin propeller rotation assembly, a lower part of said main gear connected to said synchronous belt gear, said synchronous belt gear connected to said minor rotation assembly of said twin propeller rotation assembly, an upper end of said belt pulley connected to said tail rotation assembly, a middle part of said belt pulley engaged said main gear, a lower end of said belt pulley connected to said synchronous belt gear.

2. The power assembly of claim 1, wherein said upper end of said belt pulley connected to said tail rotation assembly by a belt, said lower end of said belt pulley connected to said synchronous belt gear by a belt.

3. The power assembly of claim 1, wherein said motor assembly further comprising a fuel pump, said fuel pump setting between said fuel tank and said motor.

4. The power assembly of claim 1, wherein said main gear, said synchronous belt gear, and said belt pulley have the same modulus.

5. A coaxial twin propeller model helicopter including a bracket and a twin propeller rotation assembly, a power assembly, a landing gear, an electronic module, a steering gear, and a tail rotation assembly installing on said bracket, said power assembly driving said twin propeller rotation assembly and said tail rotation assembly, said electronic module controlling said steering gear, said steering gear realizing steering control of model helicopter by controlling the inclination direction of said twin propeller rotation assembly, said twin propeller rotation assembly including a main rotation assembly and a minor rotation assembly, wherein said power assembly comprising:

a motor assembly, said motor assembly comprising a motor, a motor gear, and a fuel tank, said motor and fuel tank fixed on said bracket, said motor connected to said motor gear, said fuel tank provided fuel to said motor by a pipe, said motor driving said motor gear, and a gear assembly, said gear assembly comprising a main gear, a synchronous belt gear and a belt pulley, said main gear engaged said motor gear, said main gear connected to said main rotation assembly of said twin propeller rotation assembly, a lower part of said main gear connected to said synchronous belt gear, said synchronous belt gear connected to said minor rotation assembly of said twin propeller rotation assembly, an upper end of said belt pulley connected to said tail rotation assembly, a middle part of said belt pulley engaged said main gear, a lower end of said belt pulley connected to said synchronous belt gear.

6. The coaxial twin propeller model helicopter of claim 5, wherein said main rotation assembly comprising a plurality of main blade, a main blade clip, a hollow axle, and an inclined plate, said main blade evenly distributed in said main blade clip, the upper end of said hollow axle fixed and connected to said main blade clip, the lower end of said hollow axle fixed and connected to said main gear, said inclined plate connected between said main blade clip and said steering gear, said main gear driving said main blade clip rotating, said steering gear controlling inclination direction of said main blade clip through driving said inclined plate.

7. The coaxial twin propeller model helicopter of claim 5, wherein said minor rotation assembly comprising a plurality of minor blade, a minor blade clip, a small axle, and a balancing rod assembly, said minor blade evenly distributed in said minor blade clip, said small axle passing through said minor blade clip and fixing connected to said minor blade clip, the lower end of said small axle fixed and connected to said synchronous belt gear, the top of said small axle fixed and connected to said balancing rod assembly, said synchronous belt gear driving said minor blade clip and balancing rod assembly rotating.

8. The coaxial twin propeller model helicopter of claim 5, wherein the upper end of said belt pulley connected to said tail rotation assembly by a belt, and the lower end of said belt pulley connected to said synchronous belt gear by said belt.

9. The coaxial twin propeller model helicopter of claim 5, wherein said motor assembly further comprising a fuel pump, said fuel pump setting between said fuel tank and said motor.

10. The coaxial twin propeller model helicopter of claim 5, wherein said main gear, said synchronous belt gear, and said belt pulley have the same modulus.

* * * * *